US008077016B2

(12) United States Patent
Cohen

(10) Patent No.: US 8,077,016 B2
(45) **Date of Patent: *Dec. 13, 2011**

(54) METHOD AND APPARATUS FOR REMOTELY CONTROLLING A PLURALITY OF DEVICES

(75) Inventor: Richard S. Cohen, Plains, PA (US)

(73) Assignee: Scheidner Research LLC, Dover, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/575,395

(22) Filed: Oct. 7, 2009

(65) Prior Publication Data

US 2010/0026471 A1 Feb. 4, 2010

Related U.S. Application Data

(63) Continuation of application No. 12/049,988, filed on Mar. 17, 2008, now Pat. No. 7,619,504, which is a continuation of application No. 11/473,395, filed on Jun. 23, 2006, now Pat. No. 7,362,213, which is a continuation of application No. 10/388,330, filed on Mar. 13, 2003, now Pat. No. 7,098,772.

(60) Provisional application No. 60/383,875, filed on May 28, 2002.

(51) Int. Cl.
*G08B 1/00* (2006.01)

(52) U.S. Cl. ..... 340/309.16

(58) Field of Classification Search ..... 340/309.16, 340/310.11, 593, 500, 568.3, 692, 3.1, 10.52; 348/725; 725/25

See application file for complete search history.

(56) References Cited

U.S. PATENT DOCUMENTS

| | | | | |
|---|---|---|---|---|
| 3,983,553 | A | | 9/1976 | Kesling |
| 4,306,293 | A | | 12/1981 | Marathe |
| 4,418,333 | A | | 11/1983 | Schwartzbach et al. |
| 4,510,778 | A | | 4/1985 | Cotton |
| 4,703,306 | A | | 10/1987 | Barritt |
| 5,046,157 | A | * | 9/1991 | Smith et al. ..... 340/309.8 |
| 5,051,837 | A | * | 9/1991 | McJunkin ..... 725/26 |
| 5,083,122 | A | | 1/1992 | Clark |
| 5,203,848 | A | | 4/1993 | Wang |
| 5,231,661 | A | * | 7/1993 | Harnum et al. ..... 725/29 |
| 5,267,734 | A | | 12/1993 | Stamper et al. |
| 5,331,353 | A | * | 7/1994 | Levenson et al. ..... 725/29 |
| 5,377,269 | A | | 12/1994 | Heptig et al. |

(Continued)

FOREIGN PATENT DOCUMENTS

WO 03/100994 4/2003

OTHER PUBLICATIONS

United States Patent and Trademark Office, PCT; International Search Report; PCT/US03/16727; Jun. 4, 2004; 3 Pages.

(Continued)

*Primary Examiner* — Phung Nguyen

(74) *Attorney, Agent, or Firm* — Stolowitz Ford Cowger LLP

(57) ABSTRACT

Disclosed is a method for controlling usage times for at least one device, including the steps of: (a) identifying a device to be controlled; (b) utilizing the device by a user; (c) tracking a device usage value for the device as the user utilizes the device; and (d) initiating an action sequence based upon the device usage value. Also disclosed is an apparatus for controlling usage times for at least one device.

23 Claims, 5 Drawing Sheets

U.S. PATENT DOCUMENTS

| | | | | |
|---|---|---|---|---|
| 5,410,326 | A | 4/1995 | Goldstein | |
| 5,465,113 | A | 11/1995 | Gilboy | |
| 5,548,345 | A | 8/1996 | Brian et al. | |
| 5,586,174 | A | 12/1996 | Bogner | |
| 5,608,389 | A | 3/1997 | Matsuzawa | |
| 5,715,020 | A | 2/1998 | Kuroiwa | |
| 5,917,256 | A | 6/1999 | Broadbent, II | |
| 5,964,661 | A * | 10/1999 | Dodge | 463/24 |
| 6,005,476 | A | 12/1999 | Valiulis | |
| 6,016,407 | A | 1/2000 | Tsukahara | |
| 6,025,869 | A | 2/2000 | Stas et al. | |
| 6,097,306 | A | 8/2000 | Leon et al. | |
| 6,112,127 | A | 8/2000 | Bennett | |
| 6,161,133 | A | 12/2000 | Kikinis | |
| 6,198,408 | B1 | 3/2001 | Cohen | |
| 6,208,042 | B1 | 3/2001 | Solis | |
| 6,256,378 | B1 | 7/2001 | Iggulden et al. | |
| 6,292,718 | B2 | 9/2001 | Staiger | |
| 6,678,824 | B1 | 1/2004 | Cannon et al. | |
| 6,781,923 | B1 | 8/2004 | Lizzi | |
| 6,917,853 | B2 | 7/2005 | Chirnomas | |
| 6,934,625 | B2 | 8/2005 | Haddad | |
| 7,047,452 | B2 * | 5/2006 | Sessa et al. | 714/47 |
| 7,048,452 | B2 | 5/2006 | Malagrino, Jr. et al. | |
| 7,098,772 | B2 | 8/2006 | Cohen | |
| 2009/0089826 | A1 * | 4/2009 | Card, II | 725/25 |

OTHER PUBLICATIONS

Stolowitz Ford Cowger LLP; Related Case Listing; Feb. 11, 2011; 1 Page.

* cited by examiner

METHOD AND APPARATUS FOR REMOTELY CONTROLLING A PLURALITY OF DEVICES

CROSS REFERENCE TO RELATED APPLICATIONS

This application is a continuation of U.S. patent application Ser. No. 12/049,988, filed Mar. 17, 2008, now allowed, which is a continuation of U.S. patent application Ser. No. 11/473,395, filed Jun. 23, 2006, now U.S. Pat. No. 7,362,213, issued Apr. 22, 2008, which is a is a continuation of U.S. patent application Ser. No. 10/388,330, filed Mar. 13, 2003, now U.S. Pat. No. 7,098,772, issued Aug. 29, 2006, which takes priority from U.S. Provisional Patent Application Ser. No. 60/383,875, filed May 28, 2002.

BACKGROUND OF THE INVENTION

1. Field of the Invention

The present invention relates generally to the remote control of a plurality of devices, and, in particular, to a method and apparatus for remotely controlling a plurality of electronic devices, such as entertainment devices and the like.

2. Brief Description of the Related Art

Children in developed nations typically have unlimited access to electronic devices, e.g., television, gaming devices and consoles, personal computers, etc., that may not always contribute to their positive growth and development. In recent years, parents and guardians have addressed this problem without tools, as it is a "family" problem, which can only be controlled when parents are at home and present with their children. At those times, when a parent or guardian estimates that any of their children are spending too much time utilizing any of these devices, they must discipline the child. Since the amount of time on these devices is rarely measured, discipline occurs at inconsistent times, generally dependent on the mood of the parent, and generally without objective information to support the discipline. As a result, discipline without any data creates a strain on the parent-child relationship, often yielding poor results. Further, such discipline does not occur at all when children are at home without parents.

A secondary problem that exists is the fact that, when entertainment device use is unlimited, children value it less. When it is limited, for example if a child can only spend 10 hours per week watching television, television viewing will become a more valued, and therefore more planned, use of time. Therefore, instead of the practice of "flipping" through television channels, children will be more likely to select a planned schedule of certain television programs, which will result in a more valuable entertainment experience for the child.

The automatic control of a variety of multiple electronic devices and appliances is well known in the art. Further, many of the control devices are able to disable an electronic device or appliance based upon an action sequence. In addition, control devices have been developed where a parent or guardian may "lock out" certain channels or control viewing using a programmable controller. Typically, these control devices are used for security systems and localized control situations. See, e.g., U.S. Pat. No. 6,112,127 to Bennett; U.S. Pat. No. 6,005,476 to Valiulis; U.S. Pat. No. 5,715,020 to Kuroiwa et al.; and U.S. Pat. No. 5,917,256 to Broadbent, II. These systems lack the sophistication, however, of allowing a parent or guardian to monitor, control and budget the time of their children's usage of one or multiple devices.

SUMMARY OF THE INVENTION

It is an object of the present invention to provide a method and apparatus for remotely controlling a plurality of devices that overcomes the deficiencies of the prior art. It is another object of the present invention to provide a method and apparatus that assists parents and guardians in limiting entertainment device usage time for their children. It is a further object of the present invention to provide a method and apparatus for remotely controlling multiple devices and power to multiple electronic devices.

The present invention is a method and apparatus for remotely controlling a plurality of devices and, in particular, multiple entertainment-related devices. The present invention is directed to a method for controlling usage times for at least one device, including the steps of: (a) identifying a device to be controlled; (b) utilizing the device by a user; (c) tracking a device usage value for the device as the user utilizes the device; and (d) initiating an action sequence based upon the device usage value. In a preferred embodiment, when the device usage value equals a device usage allotment value, the operability of the device being used is temporarily terminated.

The present invention is also directed to an apparatus for controlling usage times for at least one device and includes a control mechanism for communicating with the device and initiating an action sequence corresponding to the device; an input mechanism in communication with the control mechanism for transmitting user inputs to the control mechanism; and a visual display in communication with the control mechanism for displaying visual data, such as selection menus, inputs, outputs, computational results and alphanumeric symbols. The control mechanism: (a) identifies the device in operation; (b) tracks the device usage value for the device as a user utilizes the device; and (c) initiates an action sequence based upon the device usage value.

The present invention, both as to its construction and its method of operation, together with the additional objects and advantages thereof, will best be understood from the following description of exemplary embodiments when read in connection with the accompanying drawings.

DETAILED DESCRIPTION OF THE PREFERRED EMBODIMENTS

Figure 1:
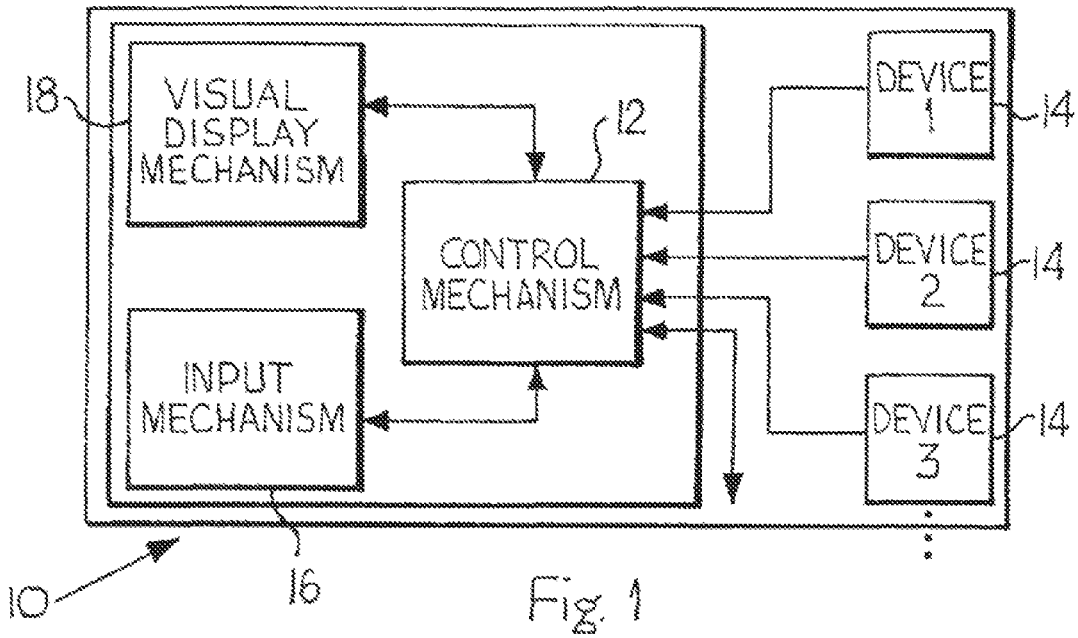
FIG. 1 is a block diagram of a preferred embodiment of an apparatus for controlling usage times for at least one device according to the present invention.

The present invention is a method and apparatus for controlling usage time for devices, and the apparatus and system 10 is illustrated in FIGS. 1 5. The apparatus 10 includes a control mechanism 12, which is in communication with multiple devices 14 or software programs, applications, processes or sub-processes resident on the device 14. This control mechanism 12 initiates action sequences that affect or change operational states of the devices 14 when certain parameters are met. While any device, appliance or software program is envisioned, in a preferred embodiment, these devices 14 are electrically operated entertainment devices, such as television, gaming devices or consoles, personal computers, computer monitors, video cassette recorders, digital video devices, a software program resident on the device, an application resident on the device, a process of the device and a sub-process of the device. Hereinafter, the term "device" includes all such devices, appliances, software programs and the like.

The control mechanism 12 is in communication with an input mechanism 16. The input mechanism 16 transmits user inputs to the control mechanism 12. Further, the input mechanism 16 may include an alphanumeric keypad, a mouse, a touch-activated display device, a pen, a trackball, a touchpad, a lever, a joystick or other devices capable of accepting input from a user and transmitting this input to the control mechanism 12. The control mechanism 12 is also in communication with a visual display mechanism 18. This visual display mechanism 18 allows a user to view certain selection menus, outputs and computational results and alphanumeric symbols, as produced or transmitted from the control mechanism 12, as well as inputs, as transmitted from the input mechanism 16.

The control mechanism 12 may be located in a dedicated housing 20, together with the input mechanism 16 and the visual display mechanism 18 mounted thereon. However, it is also envisioned that the control mechanism 12 may exist as a program on a separate device, such as a television set, a personal computer, a hand-held computer, a computing device, etc. In such cases, these devices would typically have their own visual display mechanism 18 and input mechanism 16.

Figure 2:
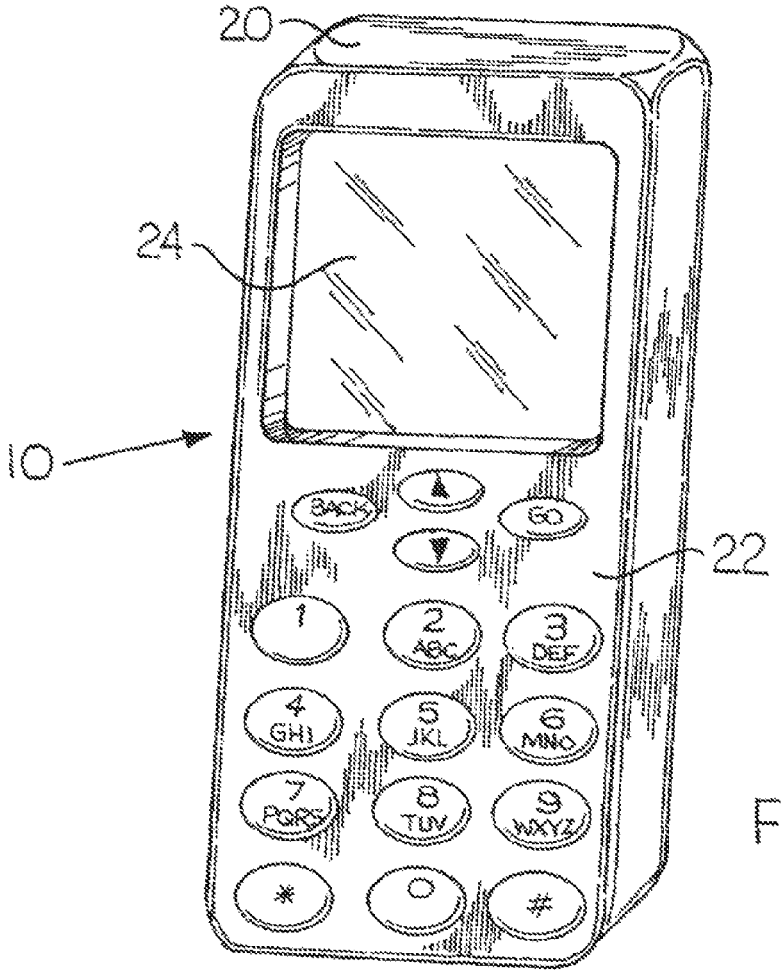
FIG. 2 is a front view of a hand-held apparatus for controlling usage times for at least one device according to the present invention.

In a preferred embodiment, the housing 20 is in the form of a hand-held, portable device, as illustrated in FIG. 2. As seen in this embodiment, this hand-held device uses an alphanumeric keypad 22 as the input device 16, and a screen 24, located on the housing 20, as the visual display mechanism 18. The housing 20 is sized such that the apparatus 10 is easily carried throughout one's dwelling.

In this preferred embodiment, the apparatus 10 includes a control mechanism 12 having a memory and a configurable database. This configurable database allows for the input, modification, deletion, and output of various variable and values, namely, multiple user accounts, device identification values unique to each of the devices 14, and device usage allotment values for each device 14 corresponding to the device identification value for each user account. In addition, each user account may be assigned a specific user identification or group assignment, as well as a password or a pass code for each user in a particular group. In addition, the device identification value may be a label, which would name the device or application to be monitored, such as "TV", "Personal Computer", or "Internet Browser".

The control mechanism 12 includes a user interface, which would allow the parent or guardian to set the settings for each user (child). In this embodiment, the parent or guardian acts as the system administrator, having system privileges, and can therefore add or delete user accounts, add or delete device identification values for devices 14, and add, modify or delete device usage allotment values for each device 14 and each user. Further, in a preferred and non-limiting embodiment, the control mechanism allows for user names, user types (restricted or unrestricted), weekday hours, weekend hours, password changing, bonus allowances (in the form of extra weekday or weekend hours), use restriction, user deletion, device selection, addition and deletion of device names and numbers, time or date selection and modification, time carryover options, language changing, day definitions and settings, hours per device, setup password changing, user statistics, device statistics, etc.

In a preferred embodiment, the apparatus 10 plugs into a typical wall outlet, either through a docking station or as a stand-alone, and communicates via X10, CEBus, RF Technology, bluetooth, and/or a computer networking protocol such as Ethernet or TCP/IP. Each switch 26 is associated with and in direct communication with a device 14. It is envisioned that any other viable communications technology may be used as well, such as the Internet, Ethernet, Infrared (IR), and hardwired connections. It is further envisioned that the Internet could permit guardians to check on children's usage when not at home.

As discussed above, while the control mechanism 12 may be a separate device, similar to a cell phone, it may also be an embedded microchip in an entertainment device, such as a television, a DVD player, a VCR, etc., in which the user interface would be accessible via an on-screen display on the television set connected to the entertainment device. Further, the control mechanism 12 may include its own housing 20, but as opposed to the screen 24 on the housing 20, the visual display mechanism 18 may be a television screen, again using an on-screen display user interface. Still further, the control mechanism 12 may be located as a program on a personal computer, where the logic and user interface would be present as software.

Figure 3A:
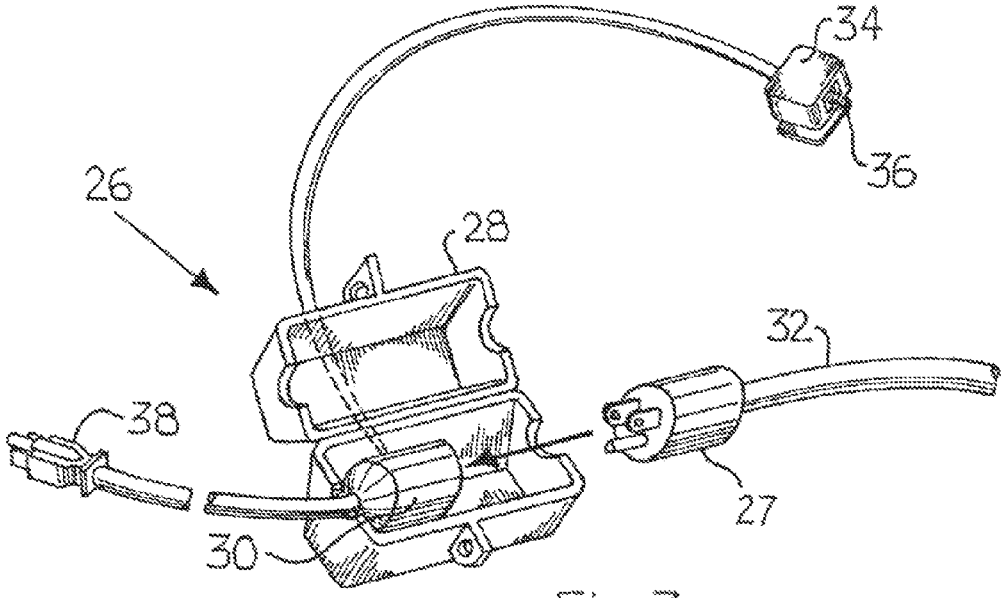
FIG. 3*a* is a perspective view of a controllable electronic communication configuration for attachment to a device according to the present invention.
Figure 3B:
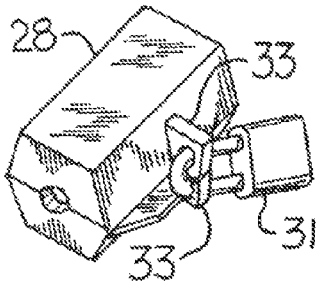
FIG. 3*b* is a perspective view of a tamper-proof enclosure for housing a device electrical controller/terminator according to the present invention.

One preferred embodiment of an electronic communication switch configuration 26 is illustrated in FIG. 3*a*. These switches 26 are devices, which accept an electrical plug 27 of an entertainment device 14, for example a television. In addition, this switch configuration 26 includes a secure, tamper-proof enclosure 28, as illustrated in FIGS. 3*a* and 3*b*.

The switch configuration 26, in a preferred embodiment, includes a hinged enclosure 28 adapted to house a power outlet 30. This power outlet 30 is configured to accept the electrical plug 27 of a device power cord 32, which passes power to its respective device 14. In addition, the power outlet 30, the electrical plug 27 and the device power cord 32 are all housed at least partially within the enclosure 28, which is lockable by a removable locking mechanism 31. For example, the removable locking mechanism 31 may be a typical lock that interacts with and is fed through projections 33 attached to the hinged enclosure 28. The removable locking mechanism 31 may require a key, pass code or other security feature to open the locking mechanism 31 from the enclosure 28, thereby allowing entry therein.

A microchip mechanism (not shown) is in communication with the power outlet 30 and is able to terminate power flow between the power outlet 30 and the device power cord 32 if instructed by the control mechanism 12. In a preferred embodiment, the microchip mechanism is installed in a microchip housing 34, and the microchip mechanism (not shown) is also in communication with an indicator light 36. It is also envisioned that the microchip mechanism is installed within the locked enclosure 28, and the indicator light 36 is attached directly to the enclosure 28. The power outlet 30 has a wall outlet connection that plugs into a standard wall outlet 44.

In this embodiment, the microchip mechanism has an embedded serial number, which the control mechanism 12 uses to identify the proper switch configuration 26 to which it should communicate an action sequence. While any number of action sequences is envisioned, typically the switch is a simple on/off switch, which would turn power to the device 14 on or off based on a command from the control mechanism 12. Since the microchip mechanism may be programmed to accept signals via the electrical system of the house from the control mechanism 12, the control mechanism 12 may then turn the entertainment device 14 on or off. It is also envisioned that the serialized or uniquely-identified microchip mechanism and power switch can be embedded into a standard size wall outlet, to be installed by an electrician in a user's wall.

Figure 4:
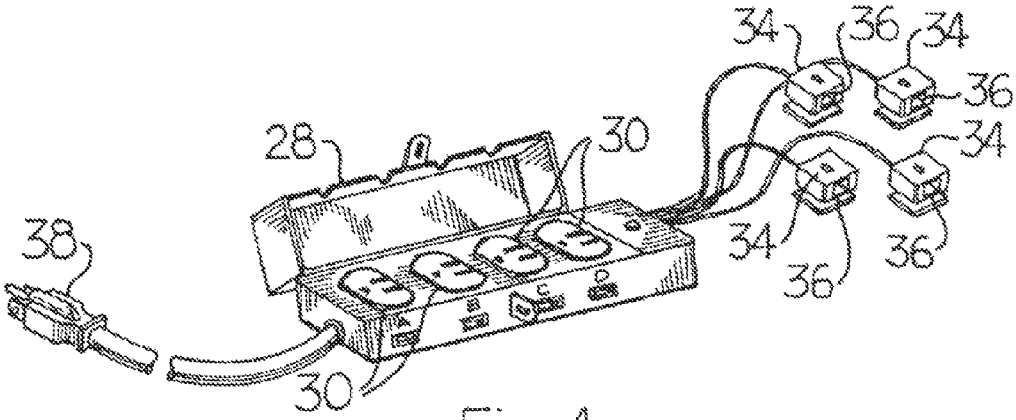
FIG. 4 is a perspective view of a controllable electronic communication configuration for attachment to multiple devices according to the present invention.

While the preferred embodiment illustrates a single enclosure 28 for use in connection with a single device 14, as seen in FIG. 4, the enclosure 28 may be sized and shaped so as to contain multiple power outlets 30. Each of multiple device electrical plugs 27 would be plugged into a respective power outlet 30, and, each power outlet 30 would have an associated indicator light 36 and/or sound warning. It is envisioned that each power outlet 30 may also have a separate microchip housing 34 housing a microchip mechanism (not shown), or that the microchip mechanism would be placed within or associated with the enclosure 28. In addition, as shown in FIG. 4, the enclosure 28 may also have one or multiple indicator lights 36 or sound warnings attached directly to the enclosure 28, thereby allowing a user easy visual or audio indication of device 14 usage. It is further envisioned that an audio or sound-producing mechanism (not shown) could be used in conjunction with the indicator light 36 or alone.

The control mechanism 12 is able to communicate with the switch configuration 26, and therefore with each device 14, thereby controlling the device 14. The indicator light 36 and/or the associated audio mechanism may provide a visual signal or audio sequence indicating that the device 14 is in use or, in an alternative embodiment, may flash, beep or otherwise indicate that the user is using or nearing the allotted usage time for a device 14.

Figure 5A:
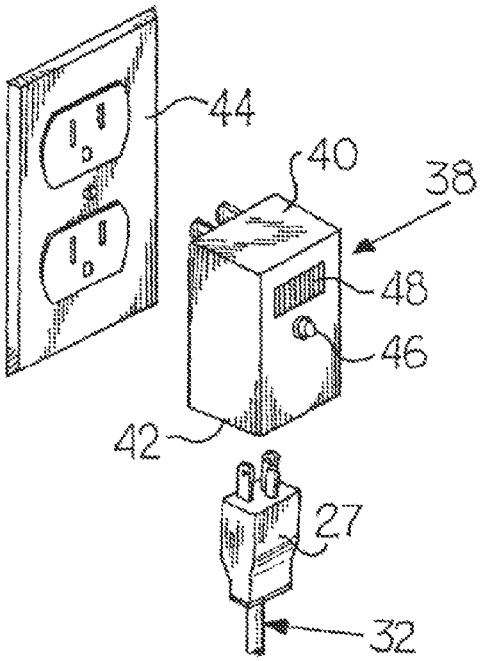
FIG. 5*a* is a perspective view of a preferred embodiment of a switch configuration and power contact device according to the present invention.
Figure 5B:
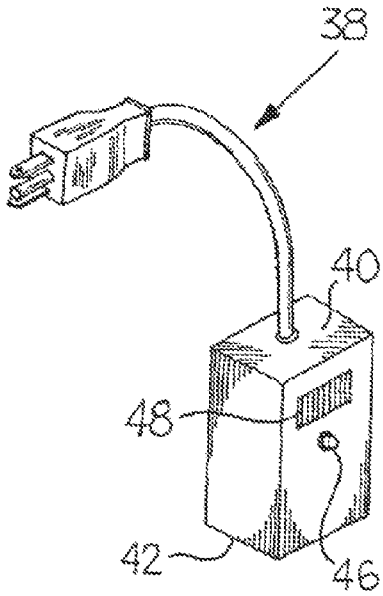
FIG. 5*b* is a perspective view of a further preferred embodiment of a switch configuration and power contact device according to the present invention.

In another embodiment, it may be preferable for the apparatus 10 to include some way for preventing or notifying the parent if a user attempts to disconnect the device power cord 32 from the power outlet 30 in order to obviate the apparatus 10. In order to avoid this, as illustrated in FIGS. 5*a* and 5*b*, the switch configuration of the apparatus 10 may also include a power contact device 38. This power contact device 38 would provide some indication whether power is passing from the power outlet 30 to the device power cord 32, and thus to the device 14 to be controlled. It is also envisioned that software could be used in connection with identifying any user attempts to gain access to "locked" software programs and applications.

In a preferred embodiment, the power contact device 38 includes a device housing 40 having one or more power contact device power outlets 42 positioned thereon. This power contact device power outlet 42 is capable of accepting the electric plug 27 of the device power cord 32 and, therefore, pass power from the power contact device power outlet 42 to the device 14. In order to power the power contact device power outlet 42, the power contact device 38 is capable of being plugged into a typical and standard wall outlet 44. Of course, the wall outlet 44 can be any standard power outlet that is integrated with the floors, ceiling or walls of one's dwelling or other similar structure.

In one embodiment, the power contact device 38 includes a load sensor (not shown) positioned within the device housing 40 and in communication with the power contact device power outlet 42. This load sensor monitors whether power is passing from the power contact device power outlet 42 to the electric plug 27 and device power cord 32, which powers the device 14. If electrical contact is broken and the power load is interrupted, the load sensor produces a signal and initiates some action based upon this break in power. This may also be achieved when the power contact device 38 includes a mechanical switch (not shown), which actuates upon a physical break in contact between the electric plug 27 of the device power cord 32 and the power contact device power outlet 42. As with the load sensor, a physical break in contact causes the mechanical switch to produce some mechanical or electrical signal and initiate an action sequence.

In the above-described embodiments, the action sequence can be visual or audio-based. In one preferred embodiment, the power contact device 38 includes an indicator light 46 that visually indicates whether power is passing from the power contact device power outlet 42 to the electric plug 27 of the device power cord 32. Additionally, indicator light 46 can provide another indication such as flashing, to reveal if power has been interrupted, which would occur if, for example, a child unplugs the power contact device 38. The visual indication can be replaced or augmented by an audio mechanism (not shown) placed within the device housing 40 and having a speaker outlet 48 associated therewith. Similar to the indicator light 46, the audio mechanism emits an audio sequence through the speaker outlet 48, also indicating whether power is passing from the power contact device power outlet 42 to the device power cord 32 or if the power has been interrupted.

Figure 8:
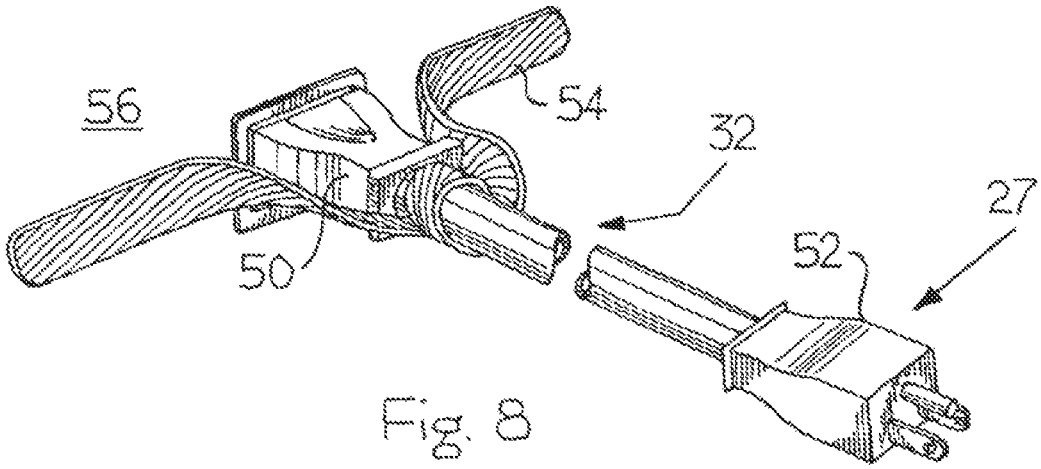
FIG. 8 is a perspective view of a device power cord device end security arrangement according to the present invention.

It may also be preferable to provide some security arrangement to prevent removal of or indicate removal of the device power cord 32 from the device 14. One such arrangement is illustrated in FIG. 8. In this arrangement, the device power cord 32 includes a device end 50 and an external power source end 52. The external power source end 52 is connectable to the power outlet 30 and/or the wall outlet 44. The device end 50 of the device power cord 32 is typically connectable to the device 14 that requires power, for example a personal computer, a VCR, etc. In the arrangement of FIG. 8, the apparatus 10 further includes a length of indication tape 54 attached to the device end 50 of the device power cord 32 and also attached to a surface 56, typically a rear surface, of the device 14 or a surface near the device 14 or the wall outlet, etc. Removal of the indication tape 54 leaves a conspicuous mark on the device surface 56. Such indication tape 54 is known in the industry, as many personal computer manufacturers put tamper-proof tape on personal computers to ensure that they are not opened. When the indication tape 54 is removed, there is a conspicuous mark left, and the indication tape 54 is not reusable.

Figure 9A:
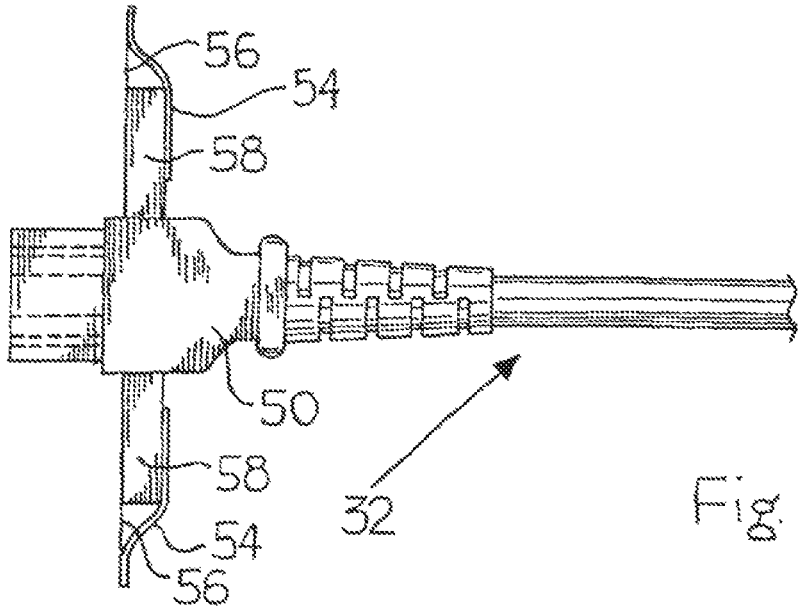
FIG. 9*a* is a top view of a device power cord device end security arrangement according to the present invention.
Figure 9B:
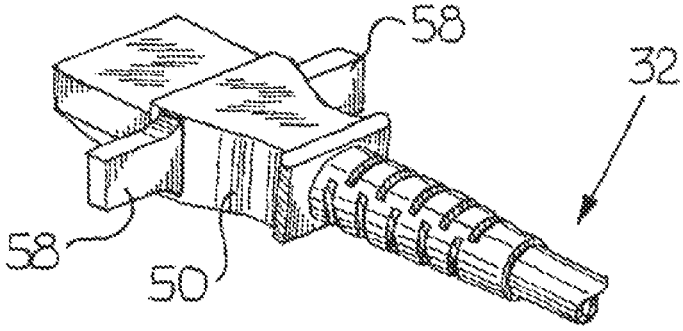
FIG. 9*b* is a side view of the device power cord device end security arrangement of FIG. 9*a*.

Another security arrangement for ensuring the non-removal or indicating the non-removal of the device power cord 32 from the device 14 is illustrated in FIGS. 9*a* and 9*b*. In this embodiment, the device end 50 of the device power cord 32 has at least one and typically multiple tab elements 58 attached to and extending from the device end 50. These tab elements 58 substantially abut the device surface 56 adjacent the device end 50. It is to these tab elements 58 that the indication tape 54 is attached. While the length of indication tape 54 may be attached to only one tab element 58, it is desirous to attach a length of indication tape 54 to each of the tab elements 58 in order to provide higher security precautions. As discussed above, when the indication tape 54 is removed, a conspicuous mark is left and the tape 54 cannot be reused. It is also envisioned that the indication tape 54 includes a unique serial number for further identification and security measures.

In operation, the parent or guardian creates a user account on a configurable database on the control mechanism 12. The parent would also input, via the input mechanism 16, device identification values, which would be unique to each of the devices 14, and thereby identify the device 14 to be controlled. Of course, it is also envisioned that the apparatus 10 be capable of performing this identification by communicating with each active switch configuration 26.

Figure 6:
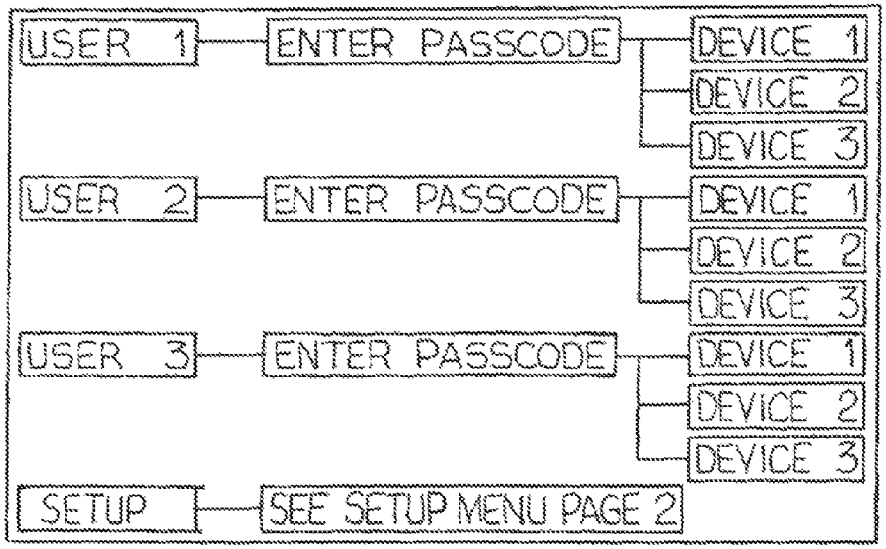
FIG. 6 is a table of menu selections for operating a control mechanism according to the present invention.
Figure 7:
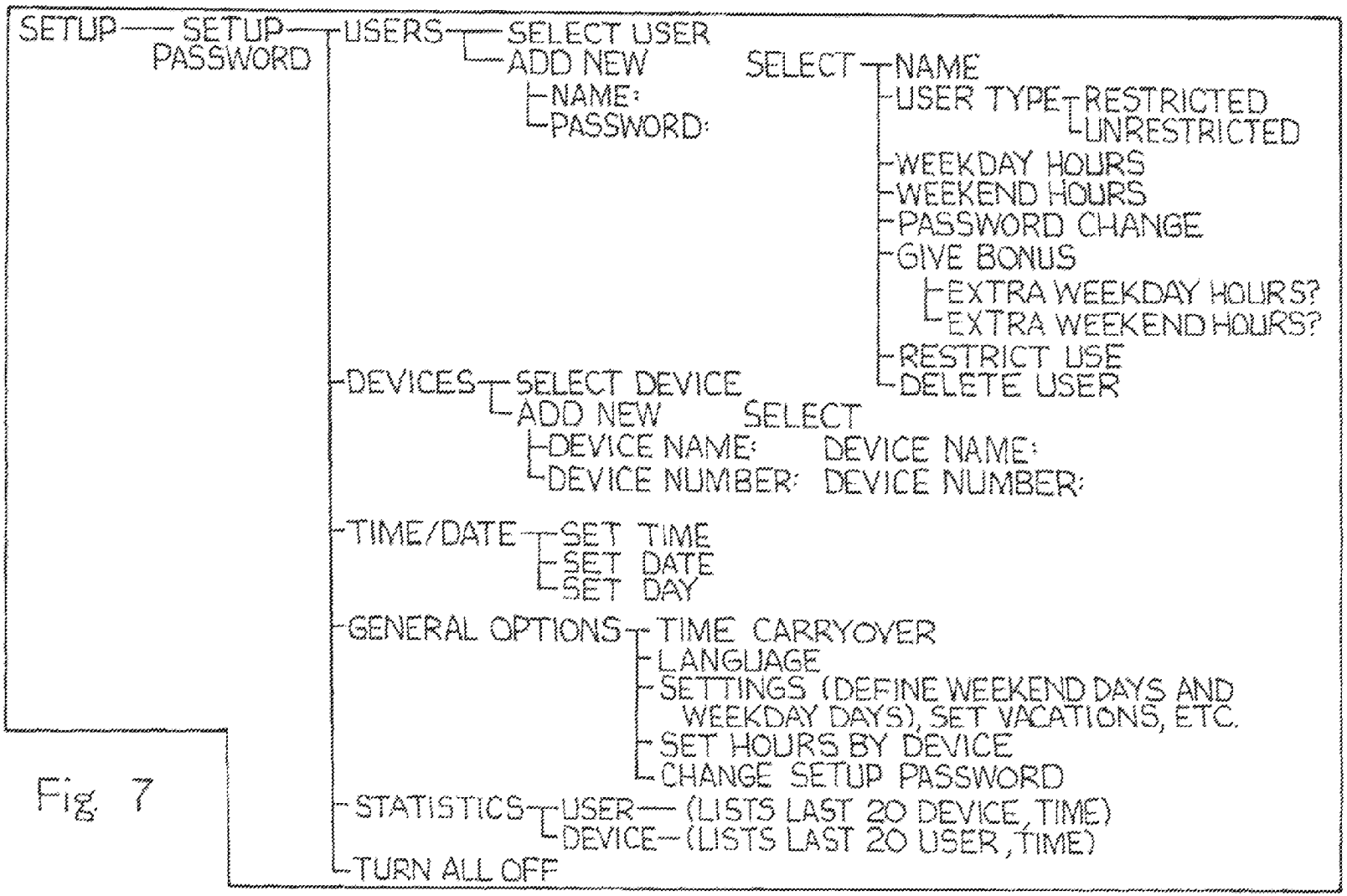
FIG. 7 is a table of further menu selections for operating a control mechanism according to the present invention.

FIG. 6 illustrates a menu structure, which is accessible by each user when the control mechanism 12 is activated. Specifically, the menu structure illustrated in FIG. 6 is for a user. Another menu structure is illustrated in FIG. 7. The menu structure in FIG. 7 is a "setup" program, and is only accessible to a system administrator, typically a parent or guardian. While the menu structures of FIGS. 6 and 7 represent one preferred embodiment of menu control, many different functions, setups and alternative structures are envisioned.

The parent or guardian must next set up device usage allotment values for each device 14 to be controlled and for each user in the user database. After this information has been entered, a user can begin using the system. Specifically, the user inputs his or her user ID and password in order to access his or her "account". The user then identifies the device 14 to be used, and begins using the device 14 if he or she has remaining time allotted.

Once the user is engaged with the device 14, the control mechanism 12 tracks the device usage value for the device 14 or software program corresponding to its device identification value. The control mechanism 12 continues to monitor the device usage value for the user as he or she uses the device 14 corresponding to the device identification value. Next, the control mechanism 12 initiates an action sequence, based upon the device usage value. Any manner of determining whether the device usage equals or exceeds the device allotment is envisioned. For example, the control mechanism 16 may accrue time and compare it to the allotted time amount or may start with the allotted time and "count down" to zero.

The apparatus 10 may also have a warning value, such that when the device usage value equals the warning value, the action sequence is a warning sequence, which somehow indicates to the user that he or she is approaching termination of their usage of the device 14. As discussed above, the indicator light 36 on the microchip housing 34 may be used to indicate this warning. However, it is also, as discussed above, envisioned that a sound alarm or other visual indicator could also be projected or initiated. After the device usage value has exceeded the warning value and equals the device usage allotment value, the control mechanism 12 instructs the switch configuration 26 to terminate power at the power outlet 30, thereby terminating power to the entertainment device 14. In this manner, when the device usage allotment value set by the parent or guardian is met, the user or child can no longer use that device 14, without gaining additional device usage allotment.

Parents or guardians may, for each child and each entertainment device 14 or software application on the device 14 in the household, allot a certain amount of hours per week and a certain amount of hours per weekend for each child and either each device 14 or all devices 14. When the child wants to use the device 14, they simply enter their user ID and/or password into the control mechanism 12 via the input mechanism 16, and the apparatus 10 allows access by allowing power to flow to that device 14. When the child is finished using the entertainment device 14, he or she simply logs off from that device 14 via the user interface on the control mechanism 12.

As discussed above, when the child runs "out of time", the indicator light 36 lights up or an audio sequence is initiated, for example, three minutes before the time limit is reached. Upon reaching the time limit, the unit or device 14 is shut off by the control mechanism 12, and the child or user is then locked out of the entertainment device 14 or devices 14 until a new time cycle begins, for example, the start of a new day, week or weekend. However, it is also envisioned that, if the device 14 is the control mechanism 16, such as on a PC, certain applications (for example, a software program, such as a video game, an Internet Browser, etc.) can have budget allotments. When the application budget time is reached, access to the application is restricted, as opposed to power termination to the device 14. Therefore, any device 14 and/or a software program resident on the device, an application resident on the device, a process of the device and a subprocess of the device may have multiple device usage allotment values, depending upon the day, date, hour or other variable.

In this manner, the apparatus 10 allows the parent or guardian to manage time budgets in a flexible manner. For example, a common time budget management technique would be to allot a certain number of hours for a five-day weekday, and a certain amount of hours for the two-day weekend. These allowable hours may be used on any device 14. In addition, time budgets may also be set up on a per device 14 basis, for example, each child may have a certain number of hours per week or per day on the television and a certain number of hours per week or per day on the video game console. Further time budgets may also be set per day instead of per weekend or weekday period, and may be easily modified in the event that the child has extra days off school, such as for Christmas vacation, etc.

It is also envisioned that the parent or guardian may add additional hours (as a bonus) or take away hours or time (as a punishment) from any weekday, weekend or day period. Further, parents may set criteria or some predetermined mathematical formula, which would give the children an incentive to spend less time on entertainment devices 14. For example, in a week that children do not use all of their hours, parents may choose to add half (or any percentage) of the number of unused hours in any given weekend to the following week or the upcoming weekend. So, for example, if a child is allotted ten hours in a five-day weekday period, and by Friday night the child only used seven of his allotted ten hours, the following week the child will have 11.5 (10 hours+1.5 hours) of time.

The user interface on the control mechanism 12 may also have a switch to shut off all of the entertainment devices 14, such that all users may be restricted at one time. For example, an angry parent may want to turn off all entertainment devices 14 for one night for all restricted users at one time. The parent may also wish to set up a schedule, where all entertainment devices 14 are shut off automatically between certain hours. For example, a parent may want all entertainment devices 14 shut off during dinner hours. In this case, the parent may program the control mechanism 12 to shut off all devices 14 between the hours of 5:00 p.m. and 7:30 p.m. This functionality allows the parent to terminate power to or otherwise affect the state of one or more of the devices 14 on a periodic, predetermined or set basis.

The control mechanism 12 also allows the parent to monitor statistics on which of their children are using which of the household entertainment devices 14 at what time. For example, a parent can select a child in the user interface of the control mechanism 12 and see the last 50 uses of each entertainment device 14 in the house, showing details of each use including device name, amount of time used, and date and time of use. The parent may also see statistics on each entertainment device 14 in the house, including the past 50 users of that device 14 and the date, time, and amount of time used for each use.

The control mechanism 12 may allow or require that no device 14 be used by a restricted user between certain hours. For example, parents may decide to disallow use of any device between the hours of 9:00 p.m. and 7:00 a.m. on weekdays. However, since the parent or guardian is the system administrator, they would be considered "unrestricted" users of the apparatus 10 and system. Any time a parent or guardian wishes to use one of the household entertainment devices 14 or other appliances connected to the system, the parent simply types in a system password, which would yield unrestricted use of any device 14. It is also envisioned that the control mechanism 12 and user interface would have a setting to change a language for the user interface.

Overall, the present invention is a method and apparatus 10 for remotely controlling multiple devices 14 and/or software programs and budgeting time for using the device 14 for each user. The present invention allows a parent or guardian to limit entertainment device 14 usage time for their children, and also allows for the remote control of multiple devices 14 and the power to these multiple electronic devices 14.

The present invention allows parents to administer "time budgets" to their children, thereby ensuring that the children spend less time on entertainment devices 14, via either limited time on entertainment devices 14 or carefully plan their limited time on entertainment devices 14 and spend more time on more viable activities. This invention will also allow parents to better manage the discipline of their children, by giving them hard data with which to discuss the problem of excessive use of entertainment devices 14.

This invention has been described with reference to the preferred embodiments. Obvious modifications and alterations will occur to others upon reading and understanding the preceding detailed description. It is intended that the invention be construed as including all such modifications and alterations.

What is claimed is:

1. A method, comprising:

receiving an indication of a request to use at least one device;

determining authorization to use the at least one device in response to allotment usage values for the at least one device; and in response to determining the authorization to use the at least one device:

providing access to the at least one device;

initiating a warning sequence in response to usage of the at least one device exceeding a warning value; and denying access to the at least one device in response to a parameter associated with the at least one device being equal to or exceeding at least one of the allotment usage values.

2. The method of claim 1, further comprising:

in response to determining no authorization to use the at least one device, denying access to the at least one device.

3. The method of claim 2, wherein denying access to the at least one device comprises switching off the at least one device.

4. The method of claim 2, wherein denying access to the at least one device comprises denying use of a software program resident on the at least one device.

5. The method of claim 1, wherein the parameter comprises an accrued time since determining the authorization to use the at least one device, a time of day, or a day of the week.

6. The method of claim 1, wherein the warning value is configured to indicate that the usage of the at least one device is approaching at least one of the allotment usage values.

7. The method of claim 1, wherein at least one of the allotment usage values comprises a range of time intervals where use of the least one device is restricted.

8. The method of claim 1, wherein at least one of the allotment usage values comprises a quantity of time to use the at least one device.

9. The method of claim 1, wherein the indication comprises a login or a password.

10. The method of claim 1, wherein the warning sequence comprises at least one of an audio sequence or a visual signal configured indicate that the usage is approaching at least one of the allotment usage values.

11. A method, comprising:

receiving a usage allotment value corresponding to each of a plurality of users of at least one of a plurality of devices;

monitoring a usage time for at least one user of at least one device;

comparing the usage time to the usage allotment value corresponding to the at least one user of the at least one device;

initiating a warning sequence in response to the usage time approaching the usage allotment value; and denying the at least one user access to the at least one device in response to the usage time being equal to or exceeding the usage allotment value corresponding to the at least one user of the at least one device.

12. The method of claim 11, wherein the at least one device comprises a plurality of devices located in a plurality of different rooms of a structure.

13. The method of claim 11, wherein denying the at least one user access to the at least one device comprises switching off the at least one device.

14. The method of claim 11, wherein denying the at least one user access to the at least one device comprises restricting use of a software program resident on the at least one device.

15. The method of claim 11, wherein the warning sequence comprises an audio sequence or a visual signal configured to alert the at least one user that the usage time is the usage allotment value.

16. A computer-readable storage device comprising computer-executable instructions stored thereon that configure a processing device to perform operations comprising:

receiving an allotment value configured to indicate an amount of usage of at least one device by at least one user;

monitoring a usage time of the at least one device by the at least one user;

comparing the usage time to the allotment value;

initiating a warning sequence in response to the usage time of the at least one device by the at least one user the approaching the allotment value; and denying the at least one user access to the at least one device in response to the usage time being equal to or exceeding the allotment value.

17. The computer-readable storage device of claim 16, wherein the at least one device comprises a plurality of devices located in a plurality of different rooms of a structure.

18. The computer-readable storage device of claim 16, wherein the processing device is configured to perform operations further comprising switching off the at least one device.

19. The computer-readable storage device of claim 16, wherein the processing device is configured to perform operations further comprising preventing the at least one user from executing a software program resident on the at least one device.

20. The computer-readable storage device of claim 16, wherein the warning sequence comprises an audio sequence or a visual signal configured to alert the at least one user that the-usage time is approaching the allotment value.

21. A device, comprising:

a memory circuit configured to store a usage allotment associated with use of a device by a user; and a control circuit configured to:

monitor a usage time of the device by the user;

initiate a warning sequence in response to the usage time of the device exceeding a warning value; and restrict access to the device by the user in response to the usage time meeting or exceeding the usage allotment.

22. The device of claim 21, wherein the control circuit is configured to communicate wirelessly with the device.

23. The device of claim 21, wherein the control circuit is configured to communicate via wired connections with the device.

* * * * *

UNITED STATES PATENT AND TRADEMARK OFFICE

CERTIFICATE OF CORRECTION

PATENT NO. : 8,077,016 B2
APPLICATION NO. : 12/575395
DATED : December 13, 2011
INVENTOR(S) : Cohen It is certified that error appears in the above-identified patent and that said Letters Patent is hereby corrected as shown below:

IN THE SPECIFICATIONS:

In Column 1, Line 10, delete “is a is a” and insert -- is a --, therefor.

In Column 3, Line 11, delete “FIGS. 1 5.” and insert -- FIGS. 1-5. --, therefor.

IN THE CLAIMS:

In Column 10, Line 29, in Claim 10, delete “configured” and insert -- configured to --, therefor.

In Column 12, Line 4, in Claim 20, delete “the-usage” and insert -- the usage --, therefor.

Signed and Sealed this
Twelfth Day of June, 2012

David J. Kappos

David J. Kappos
*Director of the United States Patent and Trademark Office*